United States Patent [19]

Hirata

[11] Patent Number: 4,697,536

[45] Date of Patent: Oct. 6, 1987

[54] UNDERWATER CLEANING APPARATUS

[75] Inventor: Kiichi Hirata, Yokosuka, Japan

[73] Assignee: West Tsusho Co., Ltd., Tokyo, Japan

[21] Appl. No.: 11,457

[22] Filed: Feb. 6, 1987

Related U.S. Application Data

[63] Continuation of Ser. No. 671,187, Nov. 14, 1984, abandoned.

[30] Foreign Application Priority Data

Feb. 27, 1984 [JP] Japan ..... 59-35638
Feb. 27, 1984 [JP] Japan ..... 59-35639

[51] Int. Cl.[4] ..... B63B 59/10

[52] U.S. Cl. ..... 114/222; 114/330; 114/333; 114/121; 114/124; 114/125

[58] Field of Search ..... 114/222, 124, 332, 330, 114/333, 121, 125; 15/87, 1.7, 104.1 C

[56] References Cited

U.S. PATENT DOCUMENTS

| | | | |
|---|---|---|---|
| 521,494 | 6/1894 | Brewster | 114/124 |
| 741,298 | 10/1903 | Binney | 114/222 |
| 936,466 | 10/1909 | Martin | 114/222 |
| 946,513 | 1/1910 | Johnson | 114/124 |
| 3,083,671 | 4/1963 | Ripley | 114/124 |
| 3,204,280 | 9/1965 | Campbell | 15/87 |
| 3,362,367 | 1/1968 | Rosfelder | 114/124 |
| 3,397,664 | 8/1968 | Slager et al. | 114/124 |
| 3,809,000 | 5/1974 | Horsford et al. | 114/124 |
| 3,922,991 | 12/1975 | Woods | 114/222 |
| 3,946,692 | 3/1976 | Sierra et al. | 114/222 |
| 4,014,280 | 3/1977 | Laxo | 114/124 |
| 4,052,950 | 10/1977 | Hirata | 114/222 |
| 4,208,752 | 6/1980 | Hofmann | 15/1.7 |

FOREIGN PATENT DOCUMENTS

| | | | |
|---|---|---|---|
| 1558595 | 2/1969 | France | 114/222 |
| 1444752 | 8/1976 | United Kingdom | 114/222 |

*Primary Examiner*—Joseph F. Peters, Jr.
*Assistant Examiner*—Thomas J. Brahan
*Attorney, Agent, or Firm*—Koda and Androlia

[57] ABSTRACT

Vessels and the like require cleaning either periodically or whenever a need arises to remove various living things such as seaweeds and shells or contaminants such as oil for the sake of appearance and proper performance. Divers were conventionally employed to manually remove them one by one using a scraper as one means to remove such substances. Such manual operation is, however, extremely inefficient, involving great amounts of time and labor especially for large ships. According to the present invention, the main body of a cleaning apparatus is pressed against an underwater object to be cleaned by means of impellers which are provided substantially at the center of the main body and driven to rotate, whereby cleaning brushes which are provided at the bottom of the cleaning apparatus concentrically with the impellers are rotated to remove substances adherent to the object while the cleaning apparatus is manipulated to run on the object's surface. Two pairs of an impeller and a brush are provided in parallel at the normal angle to the direction of forward and backward movement of the cleaning apparatus. The impellers and the brushes are driven by the same driving source as they are connected to the impellers by means of a universal joint.

10 Claims, 19 Drawing Figures

UNDERWATER CLEANING APPARATUS

This is a continuation of application Ser. No. 671,187, filed Nov. 14, 1984, now abandoned.

BACKGROUND OF THE INVENTION

The present invention relates to an underwater cleaning apparatus for cleaning and removing substances adherent to vessels or structures (hereinafter referred to as cleaning object) submerged in seas or lakes, etc.

Vessels and the like require cleaning either periodically or whenever a need arises to remove various living things such as seaweeds and shells or contaminants such as oil for the sake of appearance and proper performance. Divers were conventionally employed to manually remove them one by one using a scraper as one means to remove such substances. Such manual operation is, however, extremely inefficient, involving great amounts of time and labor especially for large ships.

Various cleaning apparatuses have been proposed such as shown in schematic views of FIGS. 1 and 2 to overcome above mentioned problems (for instance, Japanese Utility Model Application No. 32107/1978). An underwater cleaning apparatus 100 shown in FIGS. 1 and 2 comprises a main body 100A and cylindrical outer shells 101, 102 and 103 on both sides of the rear and at the center of the front of the main body 100A, respectively. Impellers 104 to 106 are concentrically provided inside the cylindrical outer shells 101 to 103, so that the bottom surface of the main body 100A is pressed against the cleaning object by the propulsion of the impellers 104 to 106 as they are driven to rotate. Three wheels 110 to 112 are provided at the bottom of the main body 100A, by steering the wheel 110 at the back end toward the direction of either left L or right R, the underwater cleaning apparatus 100 can be manipulated in any arbitrary direction. Cleaning brushes 107 to 109 are also provided at the bottom concentrically with the impellers 104 to 106 to remove substances adherent to the object. The cleaning brushes 107 to 109 are rotated as the impellers 104 to 106 are actuated so as to remove substances adherent to the object. The impeller 104 in the outer shell 101 and the cleaning brush 107 rotates in a direction opposite to the rotational direction of the corresponding impeller 105 in the outer shell 102 and the cleaning brush 108. The impeller 106 and the cleaning brush 109 in the outer shell 103 at the front rotate in the direction of either L2 or R2. For convenience, levers 114 are provided on the main body 100A for controlling and manipulating the cleaning operation as well as a railing 115 for operators to hold. On top of the outer shells 101 to 103, baskets 101A to 103A are attached to hold substances collected by cleaning operation.

With such as construction, the underwater cleaning device 100 is operated by manipulating the lever 114. Since its direction of advance is controlled by steering the wheel 110 on the rear side, the direction cannot be changed on the spot without turning it around in arc. When the wheel is steered, it becomes necessary to manipulate the lever 114 to restore its original position if the apparatus is to move straight ahead. Further, since there are an odd number (3 in this case) of impellers 104 to 106 with the cleaning brushes 107 to 109 connected thereto, the overall balance of the apparatus is difficult to be maintained despite of the efforts to maintain the balance by rotating the outer shells 101 and 102 at the back in opposite directions. This is because impellers 106 and the cleaning brush 109 in the outer shell 103 at the front must always rotate in the direction of either L2 or R2. With the conventional apparatus, the cleaning brushes 107 to 109 are fixed to the impellers 104 to 106, respectively. Although this poses no problem when cleaning a flat surface, cleaning of an irregular surface becomes difficult because the brushes per se are incapable of making vertical movement and may clash with the surface of the object depending on the position of the underwater cleaning apparatus 100 or cause themselves or the object surface to be damaged. There is provided no means to adjust the buoyancy or the posture of the main body 100A in the conventional cleaning apparatus 100. Thus, the buoyancy of the cleaning apparatus 100 may greatly vary depending on whether the water is fresh or brine, preventing smooth operations. The apparatus may become unbalanced depending on the direction or the posture of operation. It also poses problems in respect of energy consumption as it requires great force in manipulation. As the main body 100A is substantially circular in plan view, it was difficult to remove adherent substances from the corners of the object.

SUMMARY OF THE INVENTION

An object of this invention is to provide an underwater cleaning apparatus which can assure smooth and thorough cleaning of an underwater object.

Another object of this invention is to provide an underwater cleaning apparatus which is possible to change the direction thereof on the spot and to move straight ahead without manipulation of the lever.

Still another object of this invention is to provide an underwater cleaning apparatus which is possible to easily maintain the balanced posture and to control the buoyancy according to the surroundings.

According to this invention in one aspect thereof, for achieving objects described above, there is provided an underwater cleaning apparatus comprising a main body, impellers provided substantially at the center of said main body to press the same against the surface of a cleaning object by its rotation, and cleaning brushes provided on said main body at its bottom which are pressed against the object and are concentrical with said impellers to remove substances adherent to the object by rotating, said cleaning apparatus being characterized in that said main body is made movable on the object surface by the rotation and driving force of the impellers, a pair each of the impellers and the cleaning brushes are provided in parallel and at the normal angle with respect to the direction in which the apparatus moves forward and backward and the impellers and the brushes are driven by one driving source by connecting them by means of a universal joint.

According to this invention in another aspect thereof, there is provided an underwater cleaning apparatus with a buoyancy control means comprising a main body, impellers provided substantially at the center of said main body to press the same against the surface of a cleaning body by its rotation, and cleaning brushes provided on said main body at its bottom which are pressed against the cleaning object and are concentrical with said impellers to remove substances adherent to the object by rotating, said cleaning apparatus being characterized in that said main body is made movable on the object surface by the rotation and driving force of the impellers, cylindrical floats having a variable capacity are provided either in front of and at the back of or on both sides of the impellers so as to control the buoyancy of said main body of the cleaning apparatus under water.

Further, according to this invention in still another aspect thereof, there is provided an underwater cleaning apparatus with posture control means comprising a main body, impellers provided substantially at the center of said main body to press the same against the surface of a cleaning body by its rotation, and cleaning brushes provided on said main body at its bottom which are pressed against the cleaning object and are concentrical with said impellers to remove substances adherent to the object rotating, said cleaning apparatus being characterized in that said main body is made movable on the object surface by the rotation and the driving force of the impellers; and a circular fixing member which surrounds said impellers and which seals movable substance in its hollow wall so that the movable substance may move in the hollow wall in correspondence with the horizontal movement of the cleaning apparatus, is provided.

The nature, principle and utility of the invention will become more apparent from the following detailed description when read in conjunction with the accompanying drawings.

DETAILED DESCRIPTION OF THE INVENTION

The present invention will now be described in more detail.

Figure 1:
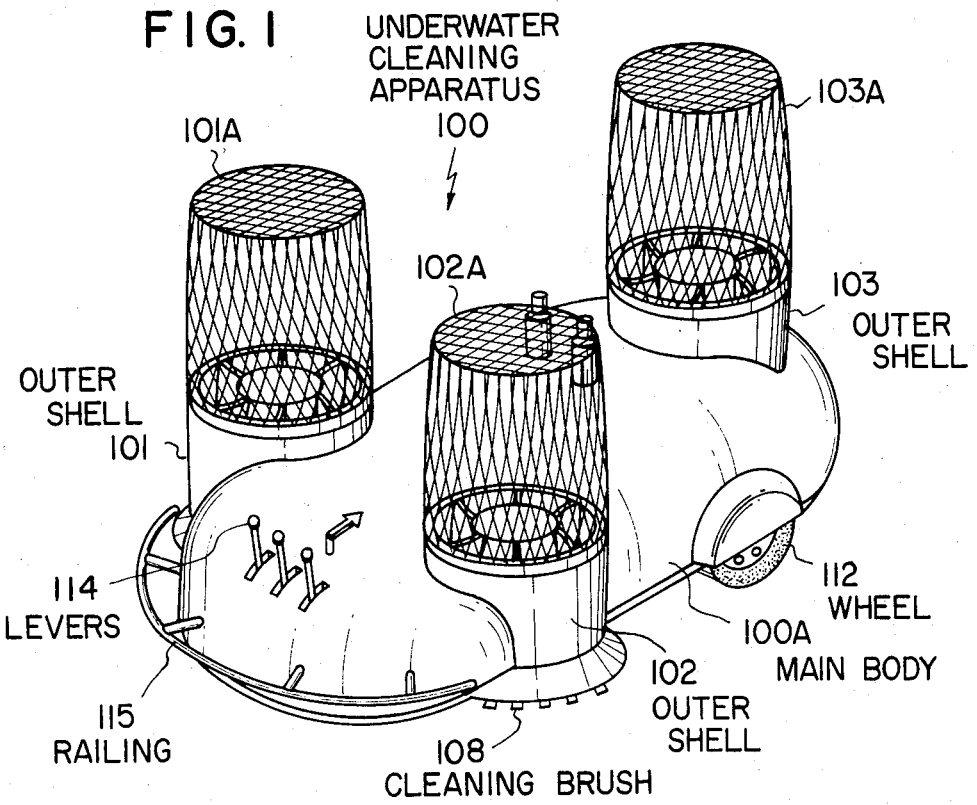
FIG. 1 is a prespective view showing one embodiment of a conventional underwater cleaning apparatus.
Figure 2:
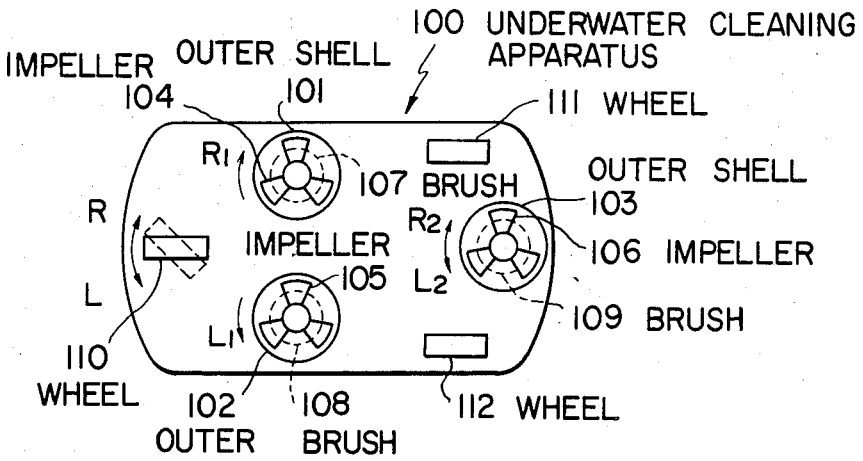
FIG. 2 is a view to explain the functions thereof.
Figure 3:
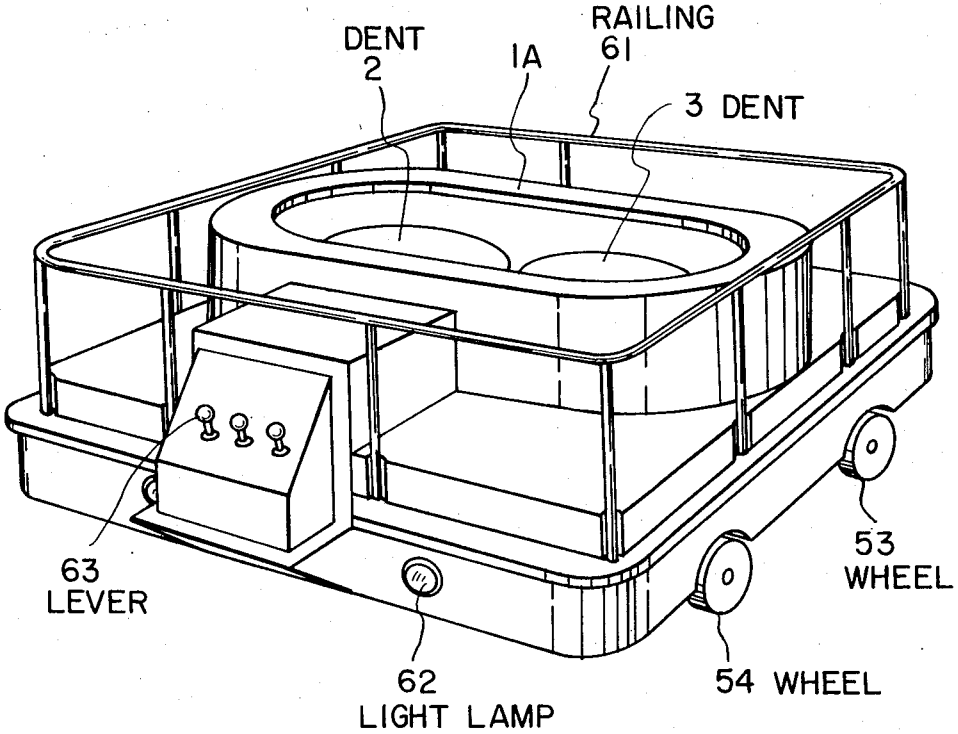
FIG. 3 is a perspective view showing one embodiment according to the present invention.
Figure 4A:
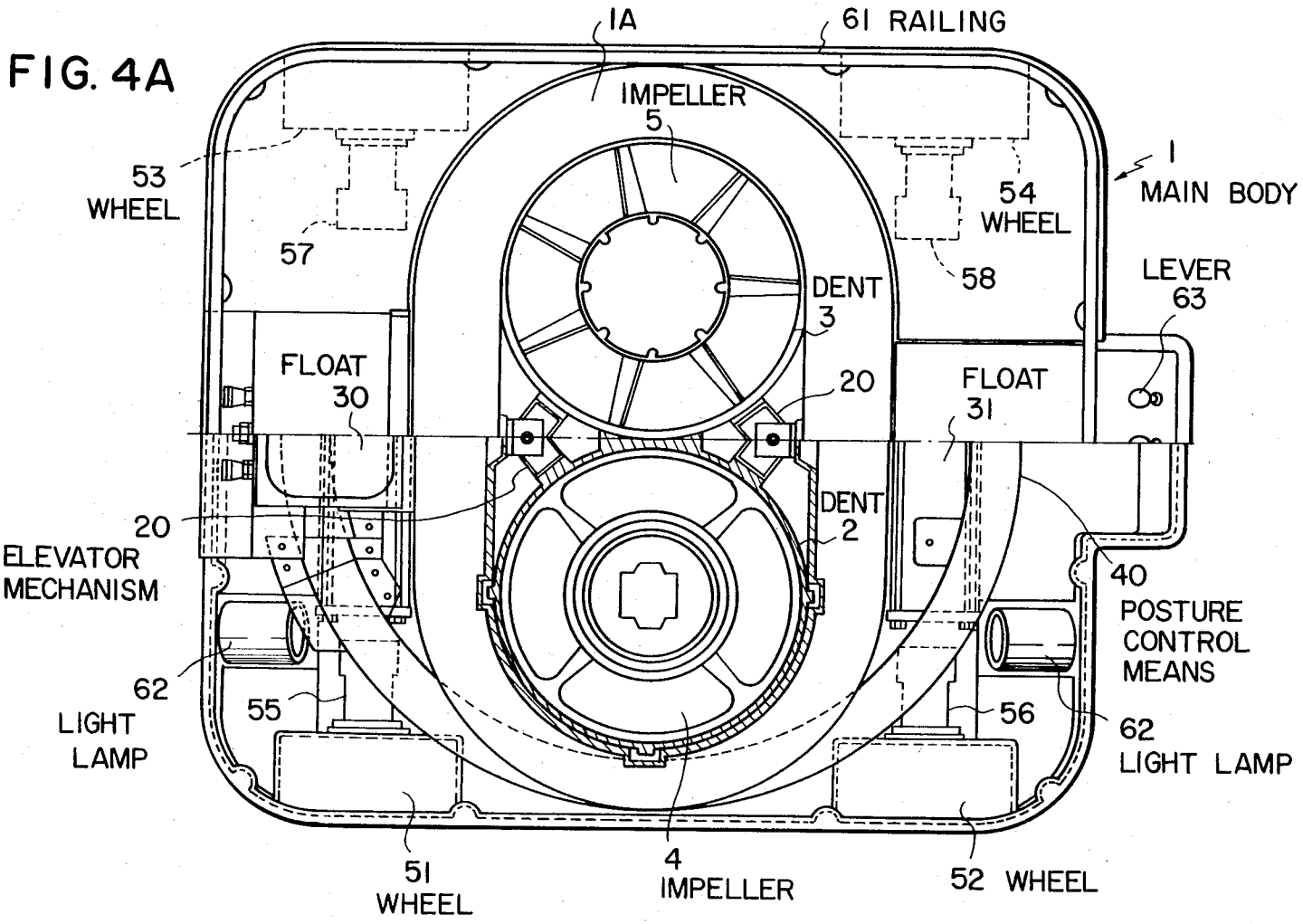
FIG. 4A is a plan view partly in section showing the structure of the embodiment.
Figure 4B:
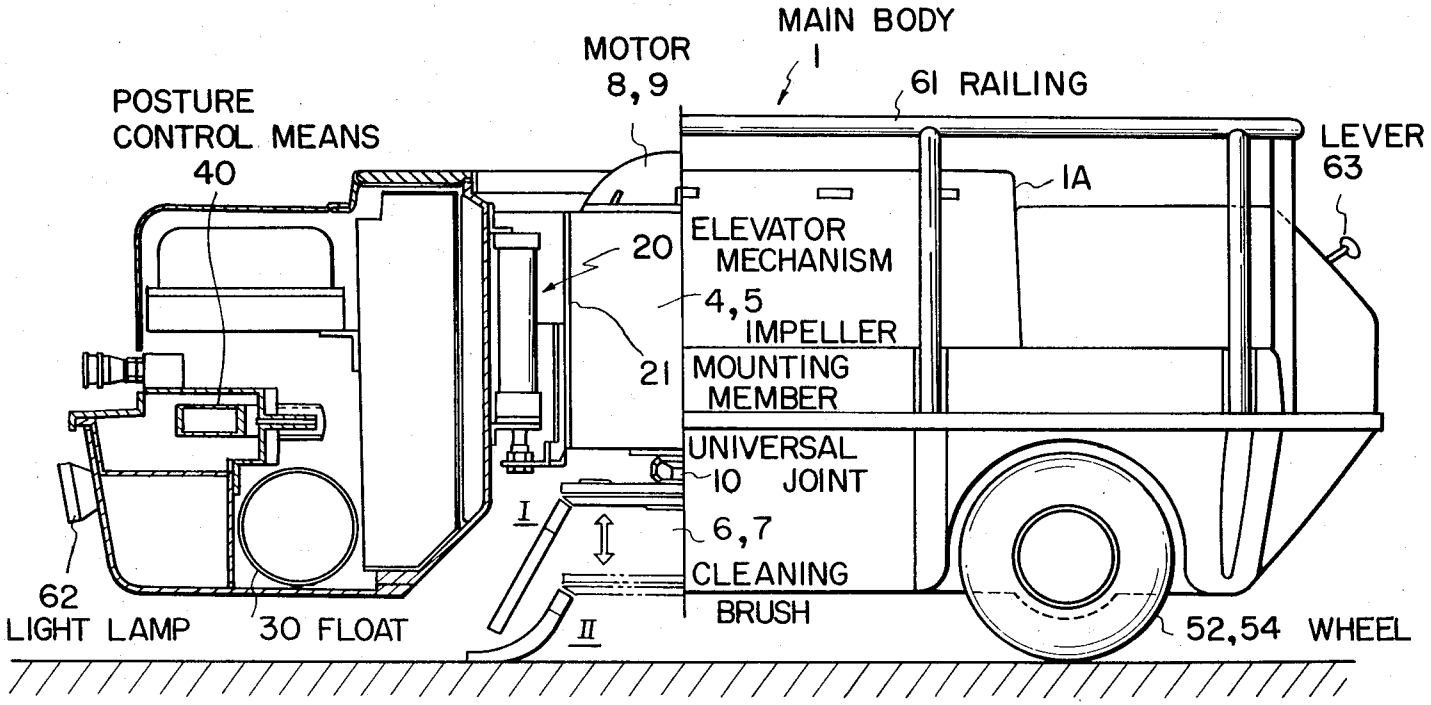
FIG. 4B is a partial sectional view showing the structure of the embodiment from the side.
Figure 4C:
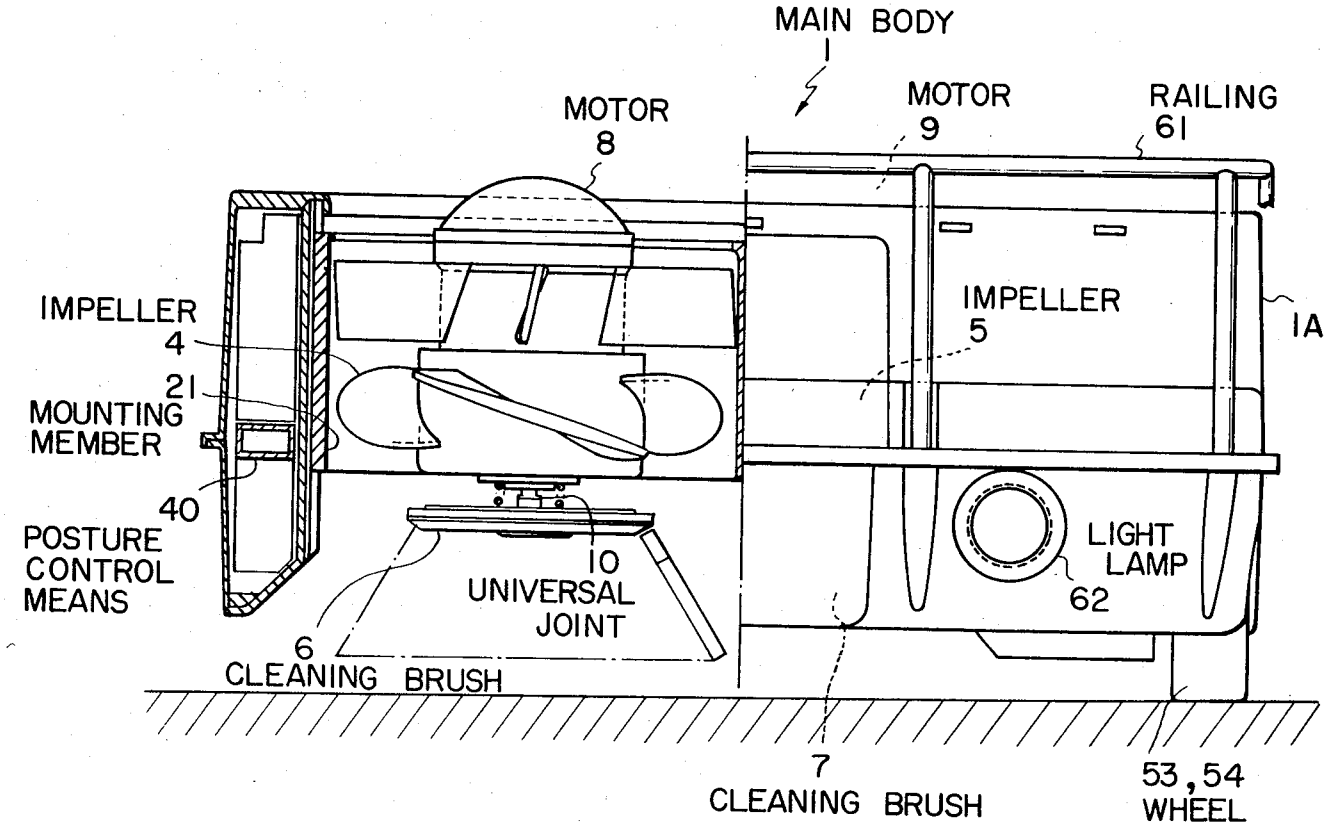
FIG. 4C is a partial view showing the structure of the embodiment.

FIG. 3 and FIGS. 4A through 4C show the appearance and the structure of one embodiment according to the present invention. The underwater cleaning apparatus according to the present invention comprises a rectangular main body 1 which is substantially a square in plan view with an elliptic cavity 1A at the center of the main body 1, cylindrical dents 2 and 3 bored inside the cavity 1A, impellers 4 and 5 inside the dents 2 and 3 respectively, and cleaning brushes 6 and 7 respectively connected to the bottom of the impellers 4 and 5 by means of a universal joint 10. Motors 8 and 9 are connected to the impellers 4 and 5 at the top thereof to drive and rotate the same in opposite directions to each other. Inside the dents 2 and 3 is also provided an elevator mechanism 20 for moving a mounting member 21 vertically by means of an oil pressure cylinder, the mounting member 21 fixedly mounting the impellers 4 and 5. The elevator mechanism 20 is controlled by lever 63 (or by remote control) provided at the rear of the cleaning apparatus 1. The mounting member 21 is also mounted fixedly with the oil pressure motor 8 (or 9), at the bottom of which is connected the impeller 4 (or 5) as well as the brush 6 (or 7) via the universal joint 10. Thus, as the mounting member 21 is vertically moved by means of the elevator mechanism 20, the cleaning brushes 6 and 7 move freely within the range between the position I (upper limit) and the position II (lower limit) as indicated in FIG. 4B.

Floats 30 and 31 are provided in parallel on the main body 1 in front of and at the back of the dents 2 and 3, respectively, for controlling the buoyancy of the apparatus to maintain its balance. Above the floats 30 and 31 is provided a posture control means 40 which surrounds dents 2 and 3 in the form of a true circle with a hollow inside so that the posture control means 40 controls the posture of the main body 1 with less energy. Four wheels 51 to 54 are provided at the four corners of the bottom of the main body 1 for mobility. The wheels 51 and 52 on one side and the wheels 53 and 54 on the other side of the axis along the direction of the forward and backward movement of the apparatus are driven independently and serially by oil pressure motors 55 through 58. A railing 61 is provided along the outer periphery of the main body 1 for the operator to hold or for other convenience. Light lamps 62 are provided at the front and back of the bottom to facilitate the operation in dim places such as at the sea bottom or to prevent any hazards. A net basket may be attached to the top of the cavity 1A to collect the removed substances.

Figure 5:
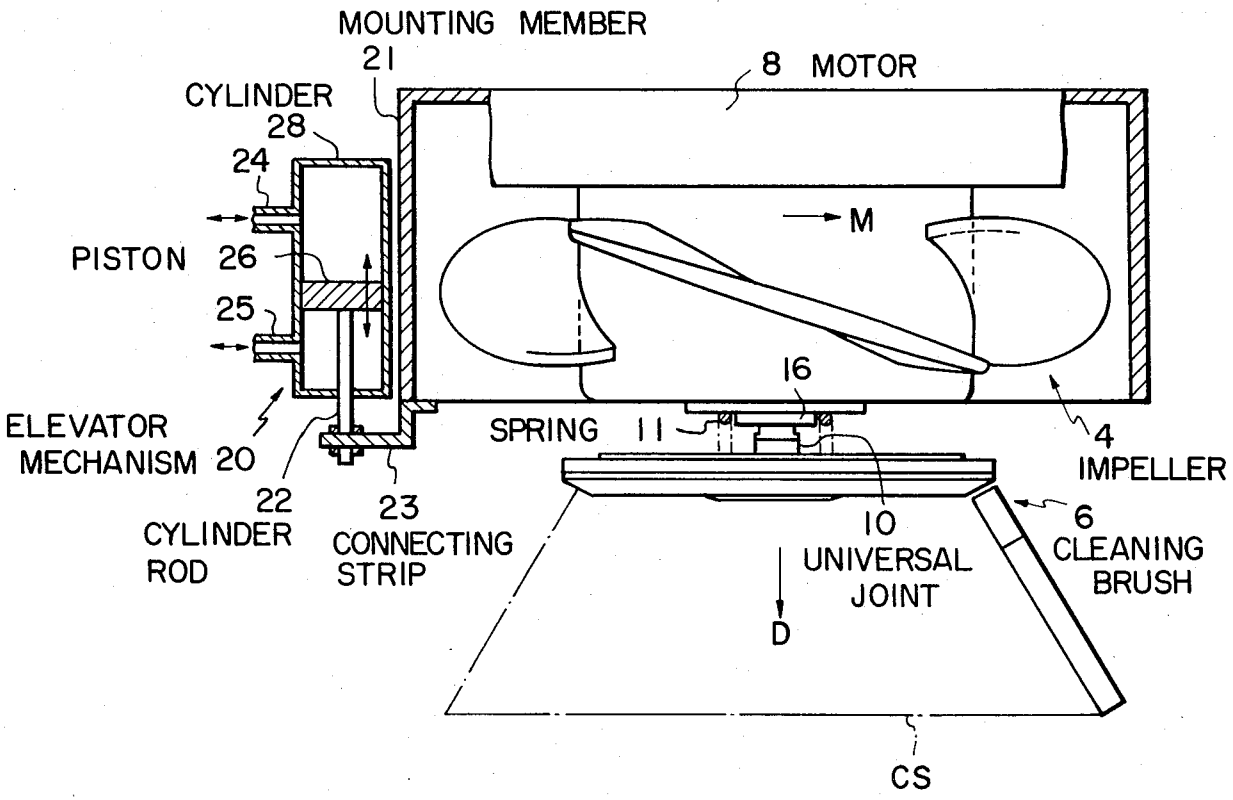
FIG. 5 is a view partly in section showing the structure of the impellers and brushes in detail.
Figure 6A:
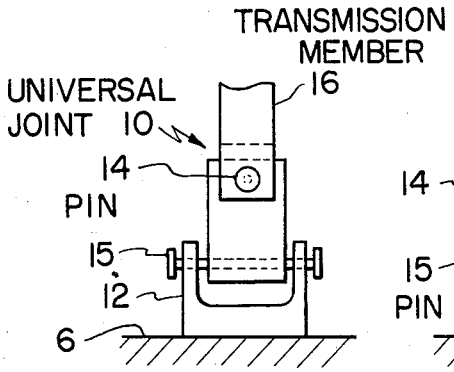
FIG. 6A is a front view showing the structure of a universal joint.
Figure 6B:
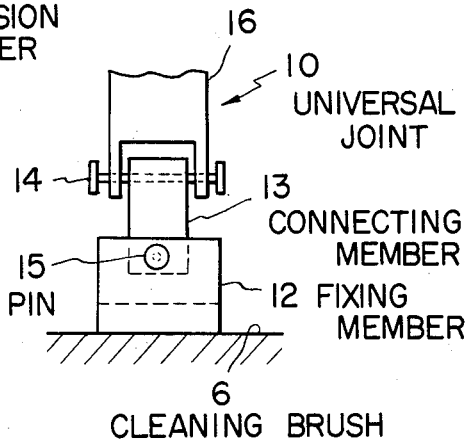
FIG. 6B is a side view thereof.

FIG. 5 shows the construction of the impellers 4 and 5 and the cleaning brushes 6 and 7 in detail together with the universal joint 10 which connects the above two members. When, for example, the impeller 4 is rotated in the direction M in the figure by means of the oil pressure motor 8, propulsion in the direction D can be obtained. The rotation of the impeller 4 is transmitted to the cleaning brush 6 via the universal joint 10. Because of the connection by the universal joint 10, the cleaning surface CS of the cleaning brush 6 can be slanted at any arbitrary angle to accommodate with the curvature of the object. A spring 11 is inserted between the impeller 4 and the cleaning brush 6 in a manner to surround the universal joint 10, so that the cleaning surface CS of the cleaning brush 6 can be maintained horizontal under normal condition. The oil pressure motor 8 is fixed to the mounting member 21 which is connected by means of a connecting strip 23 to the cylinder rod 22 of the elevator mechanism 20, the cylinder rod 22 being fixed to the mechanism at its bottom at the main body 1. The elevator mechanism 20 comprises a piston 26 and a cylinder 28 which houses the piston 26. In one section of the cylinder 28 partitioned by the piston 26, pressurized oil is flowed in or out via an injection pipe 25; in the other section, an injection pipe 25 is provided for the same purpose. By changing the amount of oil pressure in the two sections divided by the piston 26 via the injection pipes 24 and 25, the piston 26 will move vertically to thereby move the mounting member 21 via the cylinder rod 22 and the connecting strip 23 which are connected to the piston 26. FIGS. 6A and 6B show an embodiment of the structure of the universal joint 10. A fixing member 12 of the cleaning brush 6 has a dent which is in an orthogonal relation to the dent made in a transmission member 16 of the impeller 4, and between the members 12 and 16 is provided a connecting member 13. The connecting member 13 and the fixing member 12 are journalled by a pin 15, and the connecting member 13 and the transmission member 16 by a pin 14. In this manner, the rotational force from the transmission member 16 is directly transmitted to the cleaning brush 6, which, at the same time, is made capable of freely directing its cleaning surface CS at an arbitrary angle and direction. It should be noted that the structure of the universal joint 10 is not limited to the one shown in FIGS. 6A and 6B but any structure may be employed so long as the rotational force of the impeller 4 is directly transmitted to the object and the cleaning surface CS of the cleaning brush 6 which is connected to the impeller 4 is directed in correspondence with the contour of the object.

Figure 7:
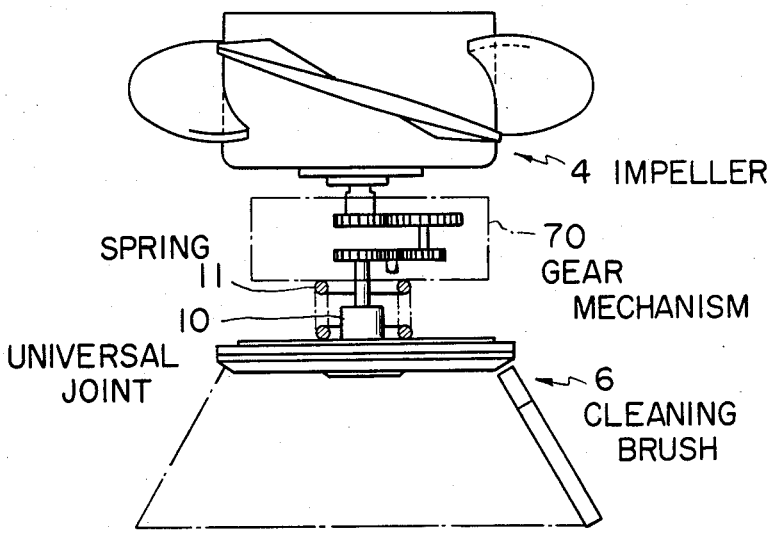
FIG. 7 is a view partly in section showing another embodiment of connecting means between the impellers and the brushes.

FIG. 7 shows another embodiment of the driving mechanism for the cleaning brushes 6 and 7. A gear mechanism 70 is interposed between the universal joint 10 and the impeller 4, so that the impeller 4 and the cleaning brush 6 connected therewith may rotate in the opposite directions. As the impeller 4 and the cleaning brush 6 rotate in the opposite directions to each other, the water flow in the dent 2 becomes even and smooth and at the same time removal and disposal of substances becomes more effective.

Figure 8:
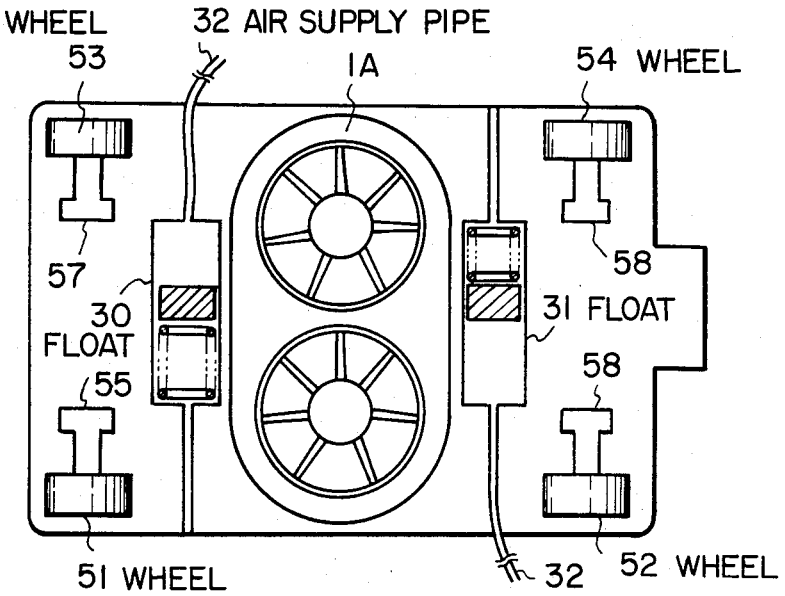
FIG. 8 is a schematic diagram showing the construction of the present invention regarding the buoyancy.
Figure 9:
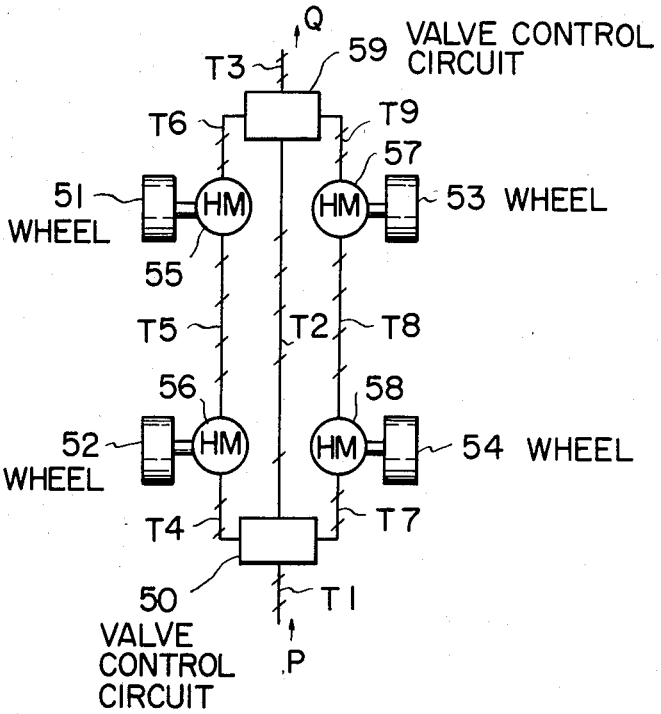
FIG. 9 and FIGS. 10A and 10B are views to explain the control means for the wheels, respectively.

FIG. 8 is a schematic diagram of the structure of the apparatus according to the present invention to show the positional relation of the floats 30, 31 and the wheels 51 through 54. The floats 30 and 31 are supplied with pressurized air via an air supply pipe 32 which is connected to a control means provided on a ship and the like. The floats 30 and 31 are positioned point-symmetrically with respect to the cavity 1A in order to maintain the overall balance of the device. The structure and the operation of the floats 30 and 31 will be described later. The wheels 51 to 54 are provided at the four corners of the bottom of the main body 1. FIG. 9 shows the driving mechanism for the wheels 51 to 54. Oil pressure is introduced from an oil pressure conduit T1 in the direction P and discharged from an oil pressure conduit T3 in the direction Q via valve control circuits 50 and 59. The valve control circuits 50 and 59 are connected directly with one another by an oil pressure pipe T2 while oil pressure motors 55 to 57 are connected by oil pressure conduits T4 to T9, respectively.

Figure 10A:
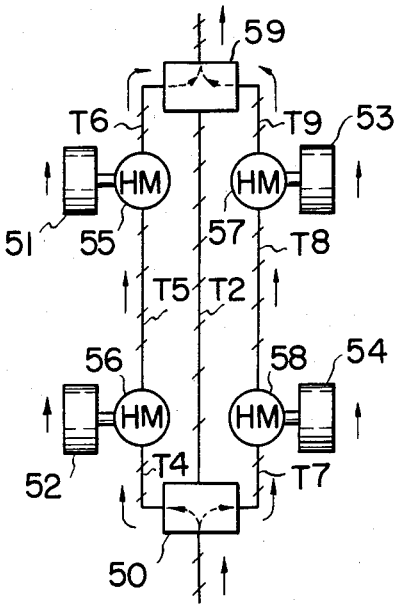
Figure 10B:
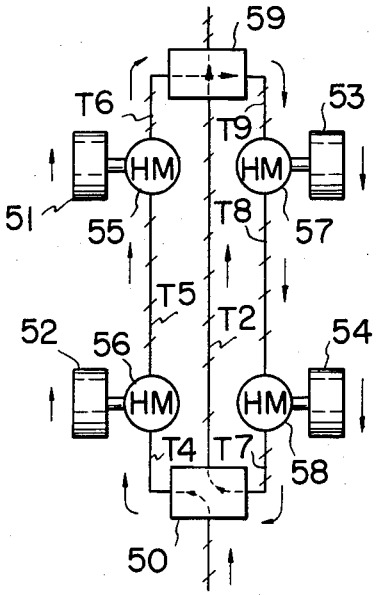

With the structure as described above, the wheels 51 and 52 and the wheels 53 and 54 are respectively regarded as one unit each arranged in parallel in the direction of the forward and backward movement of the apparatus and they may be controlled to move in the same direction at the same speed. Each wheel can also be controlled independently of the other wheels. In other words, in the case where the wheels 51 and 52 are controlled to advance and the wheels 53 and 54 are controlled in the same direction as above, the valve control circuits 50 and 59 are switched, as indicated in FIG. 10A, so as to introduce oil pressure from the valve control circuit 50 into the oil pressure motors 56 and 58 by branching out the oil pressure into the oil pressure conduits T4 and T7. The oil pressure is further introduced to the oil pressure motors 55 and 57 via the conduits T5 and T8. The oil pressure from the motors 55 and 57 is then introduced to the valve control circuit 59 via the oil pressure conduits T7 and T9 to be discharged from the oil pressure conduit T3. In this case, the amount of oil pressure to be introduced to the oil pressure conduits T4 and T7 can be individually controlled by controlling the valve control circuit 50. Thus, the speed of the motors 55 and 56 and the motors 57 and 58 may be differentiated, thereby controlling the direction of the cleaning apparatus. When the cleaning apparatus is to be moved straight ahead, it goes without saying that the motors are run at the same speed. In the case where the cleaning apparatus is to be turned around at one spot, the wheels 51 and 52 on one side of the cleaning apparatus are driven forward while the wheels 53 and 54 on the other side are driven backward (refer to FIG. 10B). This is achieved by so controlling the valve control circuits 50 and 59. Flow of the oil pressure into the oil pressure conduits T1 to T9 is controlled as shown in the figure. The cleaning apparatus can thus be turned around at one spot without taking a great span of space. Likewise, the wheels 51 and 52 may be driven backwards while the other two wheels forward. The forward and backward movements can be controlled by the valve control of the valve control circuit 59.

Figure 11A:
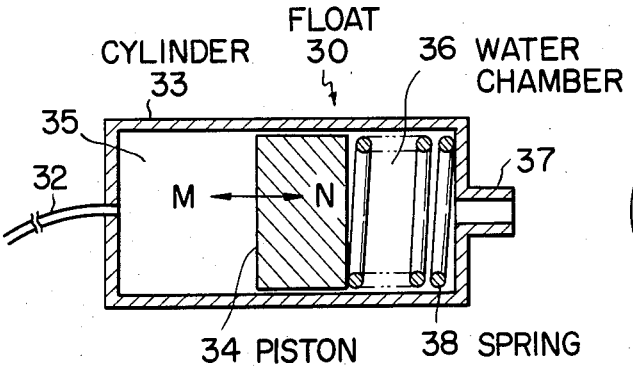
FIG. 11A is a sectional view showing the structure of a float used in the present invention.
Figure 11B:
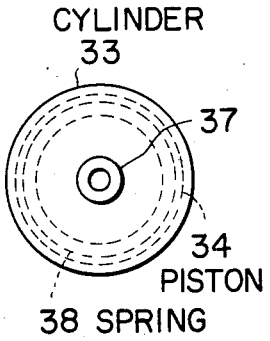
FIG. 11B is a side view thereof.

FIGS. 11A and 11B show the structure of the float 30 (or 31), which comprises a cylinder 33, and a piston 34 inserted in the cylinder 33 and attached therewith via an O-ring. The inside of the cylinder 33 is partitioned into an air chamber 35 and a water chamber 36 by the piston 34. A liquid inlet/outlet pipe 37 is provided in the wall of the water chamber 36 so that liquid such as seawater may freely flow in and out. A spring 38 is mounted in the water chamber 36 of the cylinder 33 and energizes the piston 34 at all times in the direction M. The capacity of the air chamber 35 may be varied by controlling the amount of air supplied from the air supply pipe 32 to thereby control the buoyancy of the float 30. In other words, when the air is introduced into the air chamber 35 under pressure, the piston 34 is pushed in the direction N so that the liquid in the water chamber 36 is discharged from the liquid outlet pipe 37 to thereby increase the buoyancy of the float 30. On the other hand, when the air pressure from the pipe 32 is reduced, liquid will spontaneously flow into the water chamber 36 because of the pressing action of the spring 38 and of the pressure of the deep seawater. The piston 34 is pushed in the direction M and, as a consequence, the capacity of the air chamber 35 decreases to thereby reduce the buoyance of the float 30. Thus, the capacity of the air chamber 35 is made variable by changing the amount of air supplied from the pipe 32 and the buoyancy of the float 30 can be controlled at will. Since the floats of such a construction are positioned symmetrically on both sides of the cavity 1A, the buoyancy of the cleaning apparatus can be accurately controlled while maintaining the balance. It is noted that the number of floats is not restricted to two but may be increased an may also be positioned on both sides of the apparatus.

Figure 12:
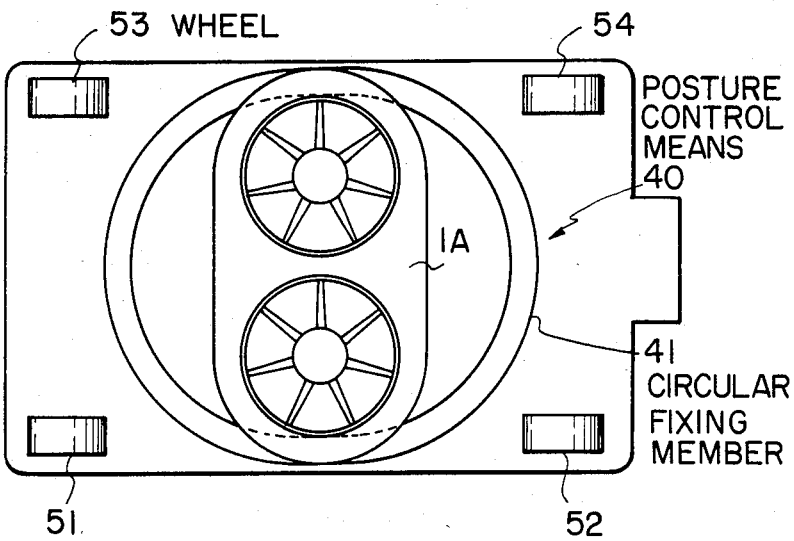
FIG. 12 is a functional view showing one embodiment of the posture control means according to the present invention.
Figure 13:
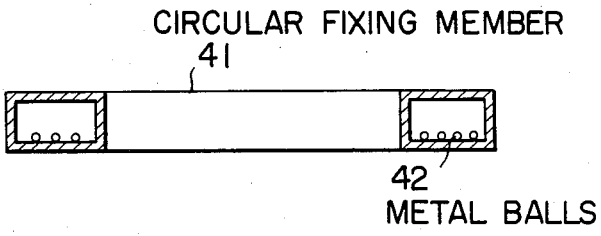
FIG. 13 is a sectional view showing the structure of the posture control means.
Figure 14:
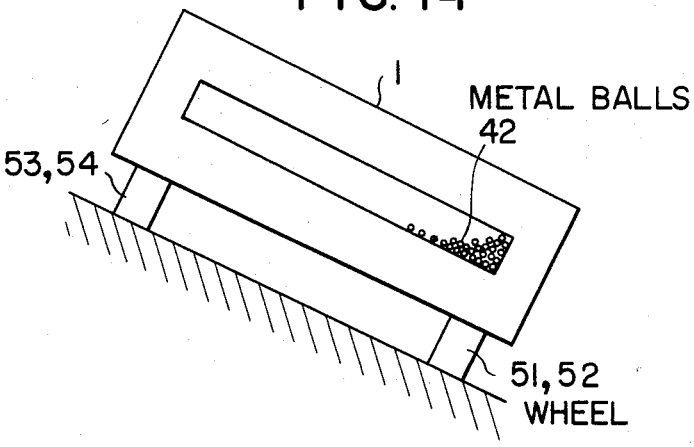
FIG. 14 is a view showing a state of the posture control means.

FIG. 12 shows the structure of the posture control means 40 according to the present invention. A circular fixing member 41 with a hollow inside is fixed to the periphery of the cavity 1A. The fixing member 41 in section is rectangular (refer to FIG. 13). Inside the member 41, there are provided a number of metal balls 42 such as used in the pin ball game. These metal balls 42 roll freely inside the hollow cavity of the circular fixing member 41. When the cleaning apparatus is at a level position, the metal balls 42 are substantially evenly distributed. When the cleaning apparatus is positioned inclined such as on a slope, the metal balls 42 will roll over to one side, as shown in FIG. 14, thus shifting the center of gravity of the cleaning apparatus. This saves energy and eliminates use of a great driving force to control the movement of the cleaning apparatus. The posture of the cleaning apparatus can thus be easily shifted at a speed with less power. The posture control of this type which helps reduction of the force required to drive the main body bears a great significance in a cleaning apparatus such as the present invention as it is manipulated and operated under water where there is almost no gravity. Although the metal balls 42 are employed in the embodiment, mercury may be sealed instead in the fixing member 41 if it can be tightly sealed therein. In the case where mercury is used, oil which has a small specific gravity may be used to cover the mercury layer so as to prevent leakage of mercury vapor.

The cleaning apparatus having the above construction is pressed against the cleaning object by propulsion generated by the rotation of the impellers 4 and 5 which are operated by the lever 63, and moves freely on the object as the wheels 51 to 54 are driven. At this stage, the cleaning brushes 6 and 7 are raised at the position I. When the cleaning apparatus reaches a position where substances to be cleaned are found, the elevator mechanism 20 is operated to lower the cleaning brushes 6 and 7 to be rotated for cleaning operation at the position II. The cleaning brushes 6 and 7 are made of metal strips or needles and are capable of removing shells and seaweeds adherent to the object by the pressing and rotating forces thereof. The buoyancy and the posture of the cleaning apparatus are also controlled at this stage by the floats 30 and 31 and the posture control means 40, respectively.

As has been described in the foregoing, the cleaning brushes 6 and 7 according to the present invention are vertically movable by means of the elevator mechanism 20. When the cleaning brushes are not in use, they are raised at the position I as shown in FIG. 4B so that they do not come in contact with the object surface while the wheels 51 to 54 are driven. When the cleaning apparatus reaches a position where cleaning is desired, the brushes 6 and 7 are lowered by means of the elevator mechanism 20 to the position II as shown in FIG. 4B, at which position they are rotated for cleaning operation. This assures thorough and accurate cleaning. As the cleaning brushes 6 and 7 are vertically movable, there is no risk of damaging either the object surface or the brushes themselves by clashing with the projected portions even when the cleaning apparatus moves on an uneven surface.

As has been described in the foregoing, the underwater cleaning apparatus according to the present invention is provided with an even number of impellers and brushes (in this case, 2) so that the apparatus does not lose its balance by the rotation of the impellers and the brushes. Provision of floats either in front of and at the rear of or on both sides of the axis along the direction of forward and backward movement enables accurate control of the buoyancy even if it may vary depending on the salt content of the seawater. As the posture control mechanism of the present invention comprises a hollow wall and moving member which may freely roll or flow inside the hollow wall, the underwater cleaning apparatus can be controlled with respect to its positions with less power because when the device is to be moved toward a slope, the moving member inside the hollow wall immediately follows suit. Moreover, there are provided four wheels in the apparatus that can be controlled independently in pairs with respect to the forward or backward movement. This eliminates steering of wheels and the apparatus can be turned around at one spot with great ease. Because the cleaning brushes are vertically movable, damages which may otherwise occur during driving of the apparatus can be prevented and accurate removal of substances is assured. As the main body of the apparatus is rectangular in plan view, it allows the tip of the brushes to reach even the small corners for thorough cleaning.

What is claimed is:

1. An underwater cleaning apparatus comprising a main body, impellers provided substantially at the center of said main body to press the same against the surface of a cleaning object by its rotation, and cleaning brushes provided on said main body at its bottom which are pressed against the object and are concentrical with said impellers to remove substances adherent to the object by rotating, said cleaning apparatus being characterized in that said main body is made movable toward the object surface by the rotation and driving force of the impellers, a pair of each of the impellers and the cleaning brushes are provided in parallel and at the normal angle with respect to the direction in which the apparatus moves forward and backward, the impellers and the cleaning brushes are driven by one driving source by connecting them by means of a universal joint, said pair of impellers are rotated in opposite directions of their associated cleaning brushes, there is provided cylindrical floats having a variable capacity at least in front of and at the back of the impellers so as to control the buoyancy of said main body of the cleaning apparatus underwater, there is provided a circular fixing member which surrounds said impellers and which seals movable substances in its hollow wall so that the movable substances may move in the hollow wall in correspondence with the horizontal movement of the cleaning apparatus, and further there is provided a wheel at each of the four corners of said main body at its bottom and the wheels on one side of the axis in the direction of the forward and backward movement are driven independently of the wheels on the other side of the axis to rotate in opposite directions at variable speeds.

2. The underwater cleaning apparatus as claimed in claim 1, wherein a gear mechanism is interposed between each of said impellers and its associated universal joint so that each of said impellers and its associated cleaning brush rotate in opposite directions.

3. The underwater cleaning apparatus as claimed in claim 2 wherein said cleaning brushes are made vertically movable.

4. The underwater cleaning apparatus with buoyancy control means as claimed in claim 1, wherein said floats respectively comprise a cylinder and a piston inserted into said cylinder so that pressurized air can be introduced into a first section of the cylindrical partitioned by the piston while surrounding water is introduced into a second section of the cylinder.

5. The underwater cleaning apparatus with buoyancy control means as claimed in claim 4, wherein said second section in the cylinder is provided with an elastic member at the inner wall thereof to energize the piston constantly toward the first section of the cylinder.

6. The underwater cleaning apparatus as claimed in claim 5, wherein said floats are operatively provided on both sides of the impellers so as to be arranged in point-symmetry.

7. The underwater cleaning apparatus with posture control means as claimed in claim 1, wherein said movable substances are metal balls.

8. The underwater cleaning apparatus with posture control means as claimed in claim 1 wherein said movable substance is mercury.

9. The underwater cleaning apparatus with posture control means as claimed in claim 1 wherein said hollow wall is rectangular in section.

10. The underwater cleaning apparatus as claimed in claim 1 wherein said wheels are driven by individual oil pressure.

* * * * *